US011517946B1

(12) United States Patent
Bullard

(10) Patent No.: US 11,517,946 B1
(45) Date of Patent: Dec. 6, 2022

(54) CONDENSATE DRAIN LINE CLEANING SYSTEM

(71) Applicant: Graydon Bullard, Ft Myers, FL (US)

(72) Inventor: Graydon Bullard, Ft Myers, FL (US)

( * ) Notice: Subject to any disclaimer, the term of this patent is extended or adjusted under 35 U.S.C. 154(b) by 440 days.

(21) Appl. No.: 16/679,534

(22) Filed: Nov. 11, 2019

(51) Int. Cl.
*F24F 13/02* (2006.01)
*B08B 9/027* (2006.01)
*F24F 13/22* (2006.01)

(52) U.S. Cl.
CPC ..... *B08B 9/027* (2013.01); *F24F 13/222* (2013.01); *F24F 2013/227* (2013.01); *F24F 2221/225* (2013.01)

(58) Field of Classification Search
CPC ..... F24F 13/222; F24F 2013/227; F24F 2221/225
See application file for complete search history.

(56) References Cited

U.S. PATENT DOCUMENTS 163,166 A 5/1875 Dunbar
5,085,244 A * 2/1992 Funk ..... F25D 21/14 134/102.1
6,068,023 A * 5/2000 Potter ..... F24F 13/222 137/240
6,457,481 B1 * 10/2002 Tarala ..... F24C 15/2057 134/107
8,479,760 B2 * 7/2013 Eads ..... F16L 41/021 285/133.11
2003/0226229 A1 * 12/2003 Bryant ..... E03C 1/304 15/304
2005/0204506 A1 * 9/2005 Beverley ..... F24F 13/222 15/341
2006/0283991 A1 * 12/2006 Nishikawa ..... B08B 9/027 241/46.013
2009/0038659 A1 * 2/2009 Ragozzino ..... F24F 13/02 134/166 C
2014/0062077 A1 * 3/2014 Hurley ..... F24F 13/222 285/7
2017/0128611 A1 * 5/2017 Prax ..... A61L 9/14
2018/0112889 A1 * 4/2018 Barker ..... B08B 9/0325

* cited by examiner

*Primary Examiner* — Filip Zec
(74) *Attorney, Agent, or Firm* — Sanchelima & Associates, P.A.; Christian Sanchelima; Jesus Sanchelima

(57) ABSTRACT

A condensate drain line cleaning system including a coil attachment assembly and a drain attachment assembly is disclosed herein. The coil attachment assembly includes a tubing body configured to be connected to the drain line that is attached to the evaporator coil of an existing air conditioning unit. The drain attachment assembly is configured to be connecting to the existing drain line located outside a user's home. A user then pours a cleaning solution into an opening in the coil attachment assembly. Afterwards, a user then actuates a shut off valve disposed on the drain attachment assembly. A user then pours hot water into the opening of the coil attachment assembly to activate the cleaner therein. After waiting a certain amount of time, the user may then re-open the shut of valve to drain all the waste present in the drain line.

5 Claims, 7 Drawing Sheets

CONDENSATE DRAIN LINE CLEANING SYSTEM

BACKGROUND OF THE INVENTION

1. Field of the Invention

The present invention relates to a condensate drain line cleaning system and, more particularly, to a condensate drain line cleaning system that allows a user to safely and easily clean the drain line of an air conditioning unit.

2. Description of the Related Art

Several designs for a condensate drain line cleaning system have been designed in the past. None of them, however, include a drain line cleaning system and method comprising an inline drain shut off T-valve, flexible transparent tubing, a clean out port and a stopper valve on the end wherein the condensate line is closed off at the T-valve closest to the drain pan. Furthermore, the shut off valve on the end of the drain line is closed and water with a cleaning solution is poured into the drain line where it sits for a long enough time to break up the clog at which point the shut off valve is then opened. Afterwards, the water and clog material exits the drain line. It is known that individuals often have to have the drain line unclogged from their existing air conditioning unit form their homes. It is also known that this process may be costly for a user, often needing to have frequent service on the drain line in order to properly unclog it. Furthermore, the current method of using a vacuum cleaner to unclog the drain line system is dangerous and could potentially lead to permanent damage to an air conditioning unit. Therefore, there is a need for a condensate drain line cleaning system that eliminates the need for a vacuum cleaner in order to properly clean the drain line of an existing air conditioning unit.

Applicant believes that a related reference corresponds to (published application) U.S. Pat. No. 8,684,022 issued for a device to clear a blockage from an HVACR condensate drain line. A piston connected to a rod with a handle is inserted directly into the distal or outlet end of a condensate drain pipe and then rapidly withdrawn to create a vacuum or suction within the drain line. When sufficient suction pressure is created, it will dislodge a blockage in the drain line. However, it differs from the present invention because the U.S. Pat. No. 8,684,022 reference fails to provide an efficient system to clean the entirety of a drain line in an existing air conditioning unit. The reference only provides a device for unclogging the drain line from outside a home and does not clean as efficiently as the present invention. The present invention addresses these issues by providing an efficient and easy to use system that will thoroughly and efficiently clean the entirety of a drain line system of an existing air conditioning unit.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide a condensate drain line cleaning system that allows a user to easily clean the drain line system of an air conditioning unit using a cleaner fluid and hot water.

It is another object of this invention to provide a condensate drain line cleaning system that allows a user to safely clean the drain line of an air conditioning unit by omitting the use of a vacuum to clean the drain line.

It is still another object of the present invention to provide a condensate drain line cleaning system that efficiently cleans the entirety of a drain line thereby saving money for a user by reducing the need of frequent cleaning.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
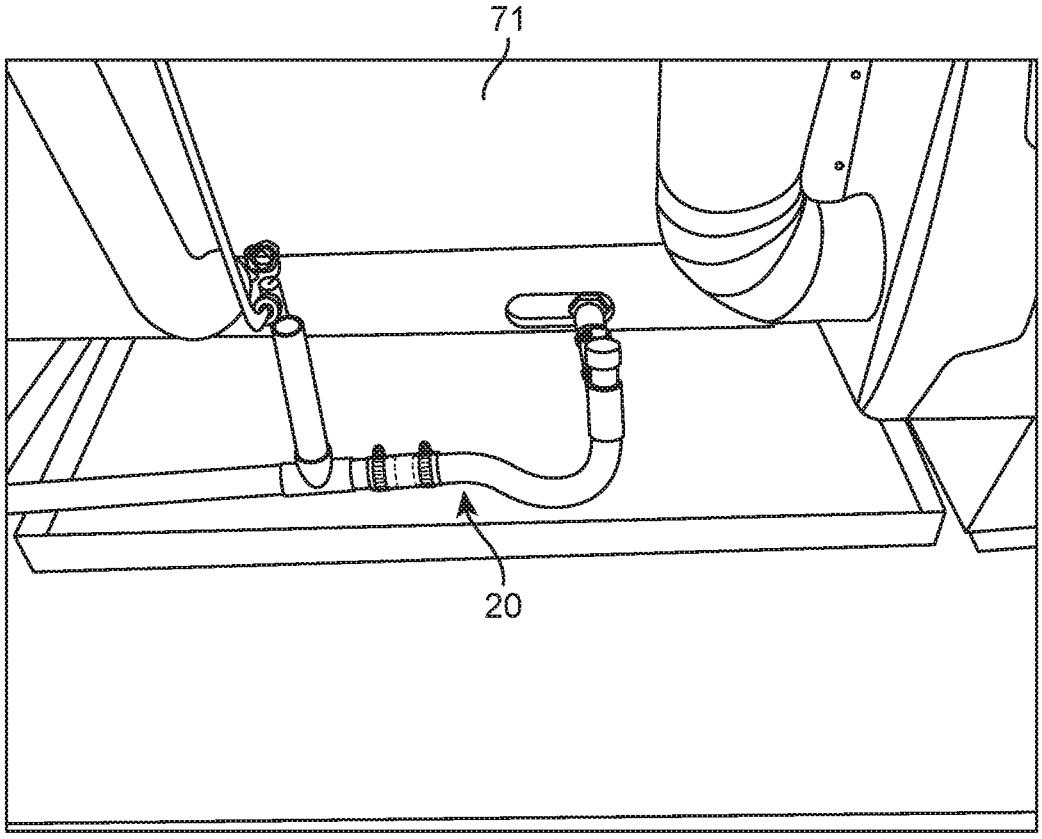
FIG. 1 represents an isometric view of a condensate drain line cleaning system 10 wherein coil attachment assembly 20 may be viewed attached to evaporator coil section 71 in accordance to an embodiment of the present invention.
Figure 2:
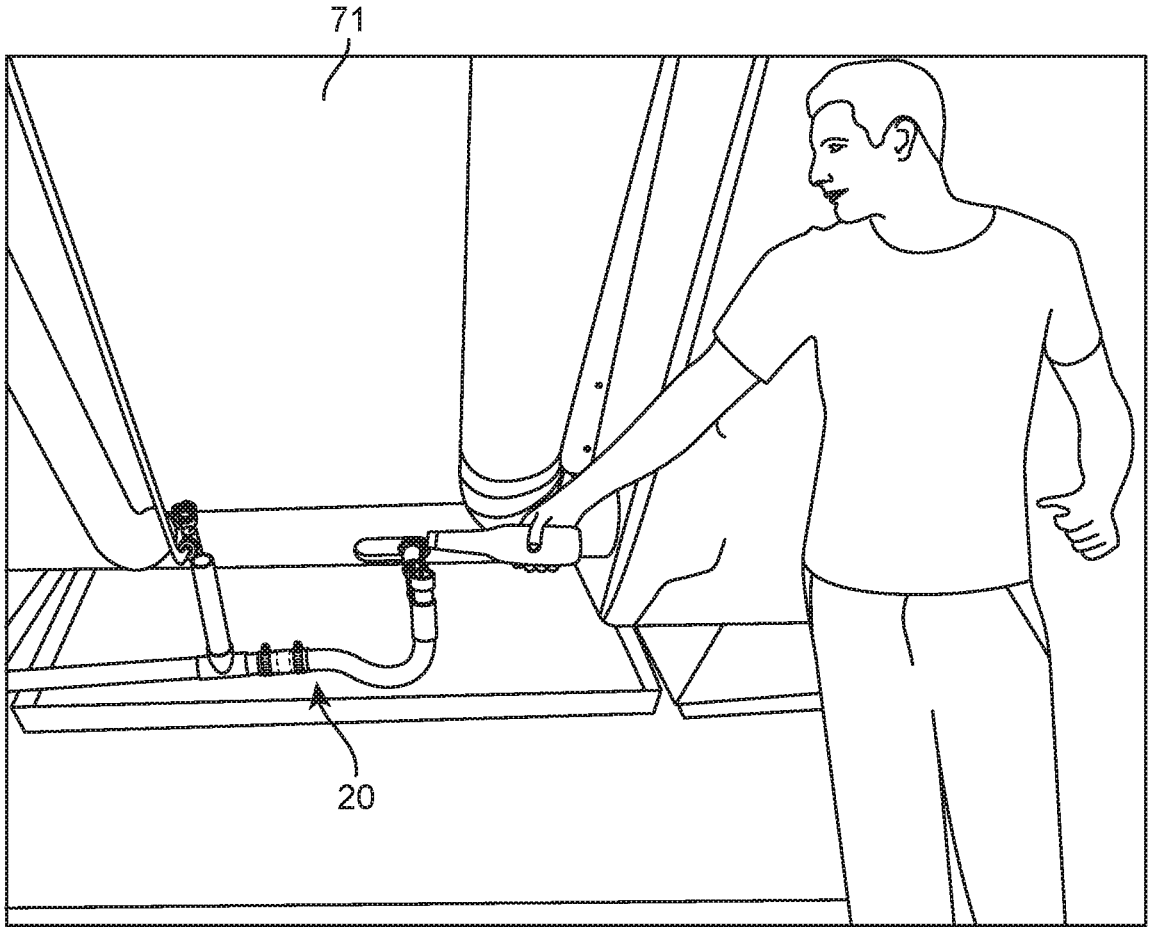
FIG. 2 shows another isometric view of condensate drain line cleaning system 10 wherein coil attachment assembly 20 may be viewed in its operating environment in accordance to an embodiment of the present invention.
Figure 3:
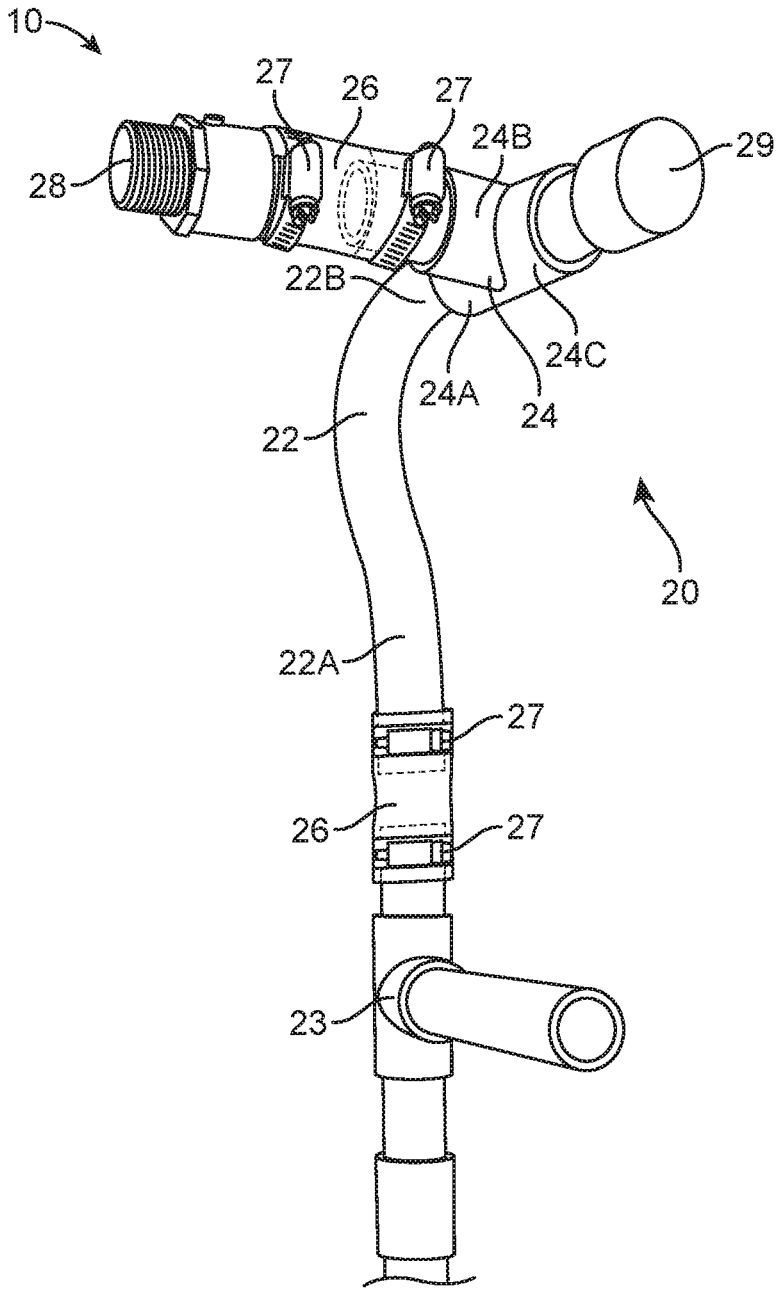
FIG. 3 illustrates an isometric view of coil attachment assembly 20 in accordance to an embodiment of the present invention.
Figure 4:
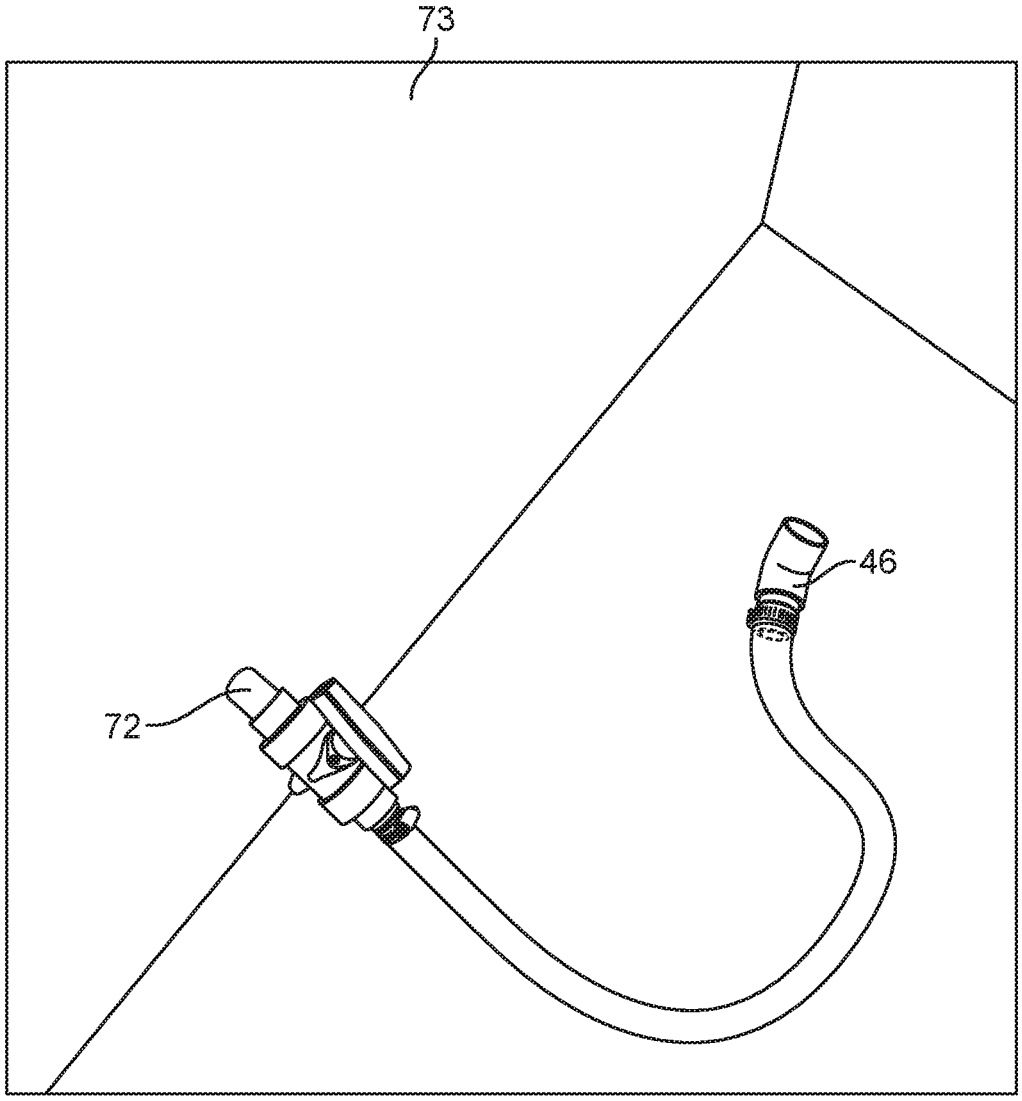
FIG. 4 is a representation of an isometric view of condensate drain line cleaning system 10 wherein drain attachment assembly 40 may be viewed attached to a drain 72 of a wall 73 in accordance to an embodiment of the present invention.
Figure 5:
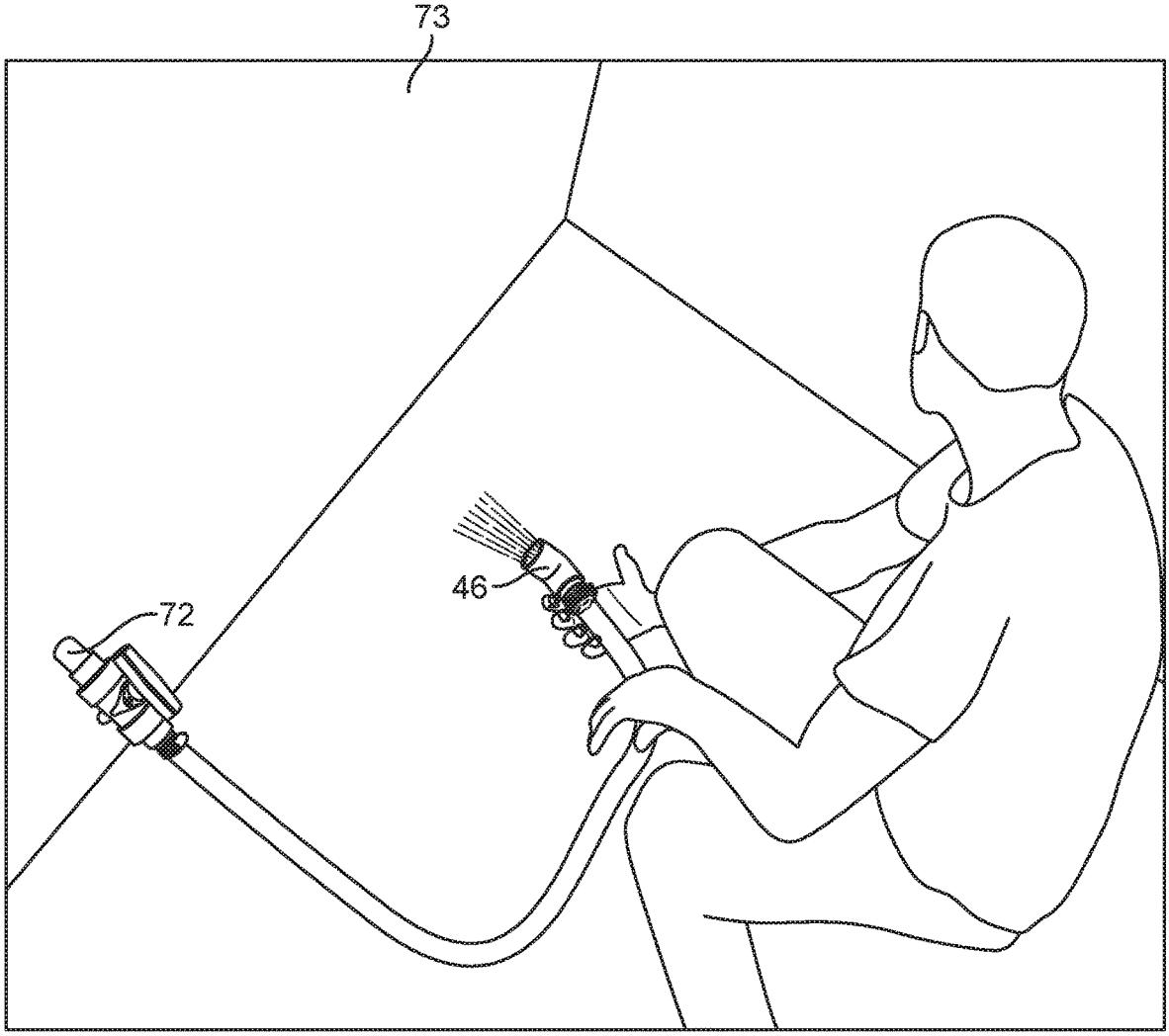
FIG. 5 shows an isometric view of drain attachment assembly 40 may be seen in tis operating environment in accordance to an embodiment of the present invention.
Figure 6:
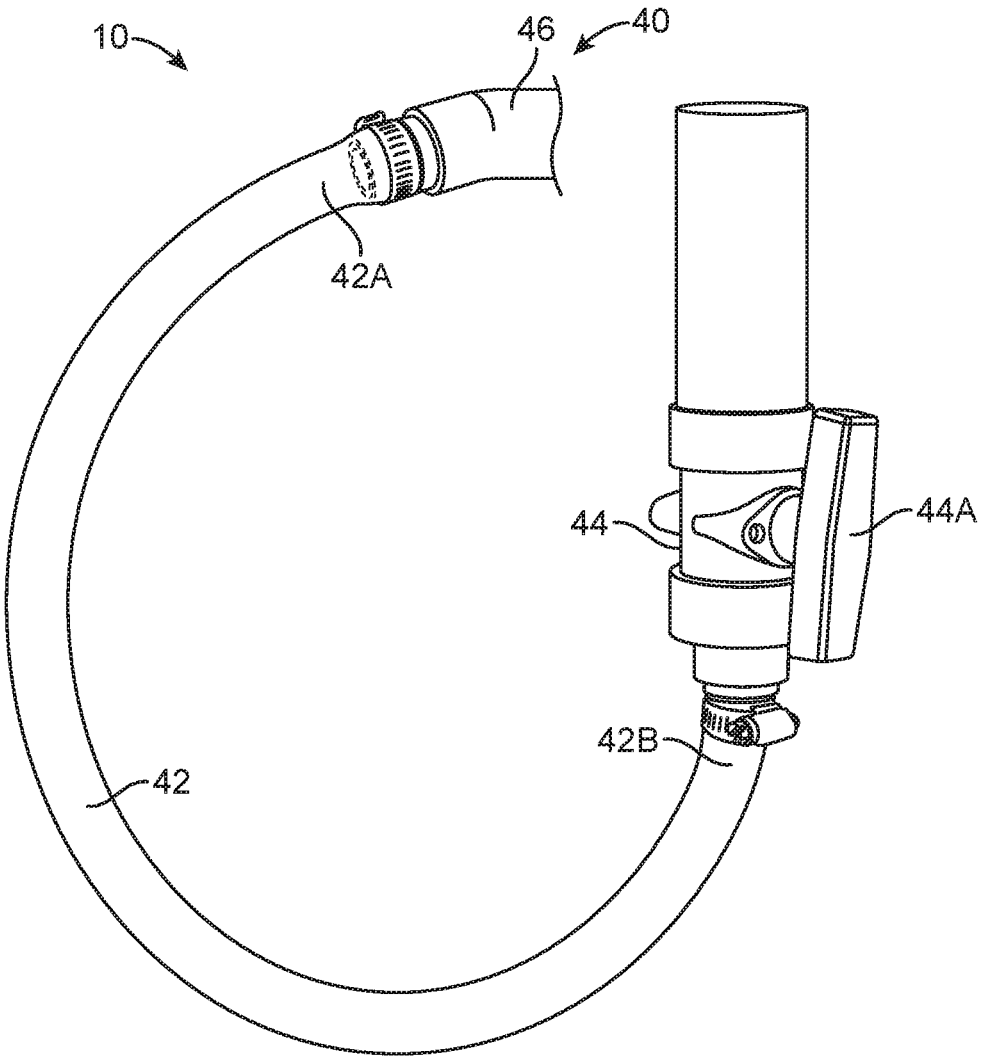
FIG. 6 illustrates an isometric view of drain attachment assembly 40 in accordance to an embodiment of the present invention.
Figure 7:
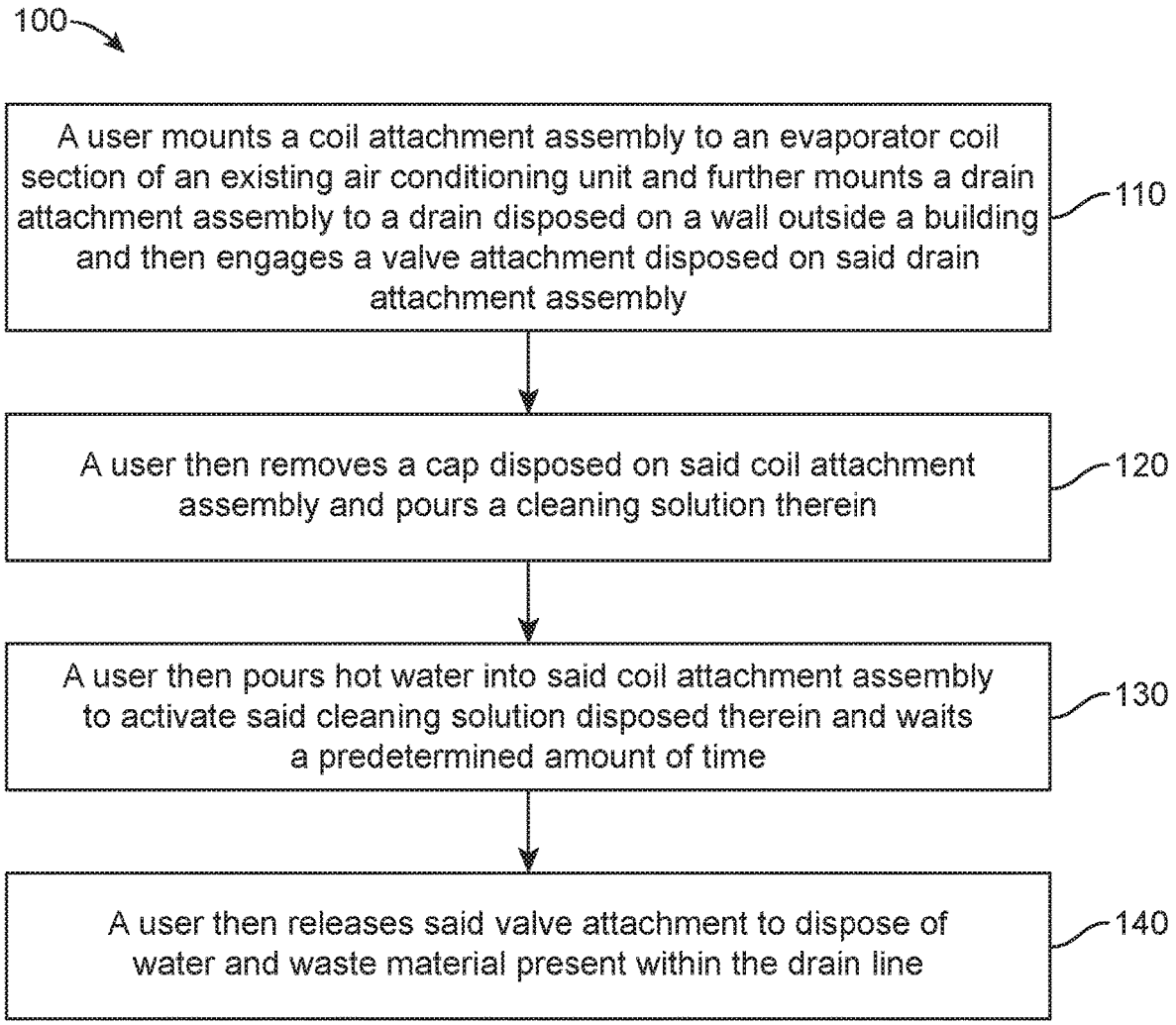
FIG. 7 is a representation of a method 100 for condensate drain line cleaning system 10 in accordance to an embodiment of the present invention.

Referring now to the drawings, where the present invention is generally referred to with numeral 10, it can be observed a condensate drain line cleaning system 10 that it basically includes a coil attachment assembly 20, a drain attachment assembly 40, and a method 100.

Coil attachment assembly 20 includes a tubing body 22 having a body first end 22A and a body second end 22B. In the present embodiment, tubing body 22 is of a cylindrical shape and made of a PVC material that is found on existing air conditioning units. However, it should be understood that tubing body 22 may be made of suitable material to be mounted onto existing air conditioning units. Additionally, tubing body 22 may comprise a hook like shape as commonly found on drain lines of existing air conditioning units. Coil attachment assembly 20 further includes a T-connector 24 having a first T-end 24A, a second T-end 24B, and a third T-end 24C mounted thereon tubing body 24. First T-end 24A is mounted onto body second end 22B of tubing body 22. In the present embodiment, T-connector 24 is comprised of the same PVC material as tubing body 22. Coil attachment assembly 20 additionally includes a clear portion 26. Clear portion 26 may be a tubing made of a clear material to allow the user to observe the contents therein tubing body 22. Clear portion 26 may be mounted thereon second T-end 24B and body first end 22A. It should be understood, that clear portion 26 is provided to be used as a reference to a user to observe the contents therein and may be omitted from coil attachment assembly 20 in another embodiment of the present invention. Clear portion 26 is mounted onto coil attachment assembly 20 using clamps 27 disposed on each end of clear portion 26. In the present embodiment, clamps 27 are of a circular variation configured to fasten clear portion 26 onto coil attachment assembly 20. It should be understood; any variety of clamps may be used to secure clear portion 26 to coil attachment assembly 20. A vent portion 23 is provided at clear portion 27 disposed on body first end 22A of tubing body 22. Vent portion 23 is given as a T-shaped PVC attachment with an opening on the top end. Furthermore, vent portion 23 allows any air present within coil attachment assembly 20 to escape. Coil attachment assembly 20 further includes a connecting member 28 mounted to second T-end 24B of T-connector 24. Connecting member 28 comprises of a cylindrical shape and may have a threaded portion disposed thereon. In the present embodiment, connecting member 28 is securely mounted to an evaporator coil section 20 of an existing air conditioner. Coil attachment assembly 20 additionally includes a cap 29 disposed on third T-end 24C of T-connector 24. Cap 29 comprises a circular shape that cooperates with that of third T-end 24C and is removably mounted thereon.

Drain attachment assembly 40 includes a clear tubing 42 having a clear tubing first end 42A and a clear tubing second end 42B. Clear tubing 42 is comprised of a suitable clear material configured to allow a user to observe the contents present therein. Additionally, clear tubing 42 is cylindrical in shape. Drain attachment assembly 40 further includes a valve attachment 44 having a valve lever 44A disposed on clear tubing second end 42B of clear tubing 42. Valve attachment 44 as known in the art may comprise a cylindrical shape and made of a PVC material. Valve lever 44A of valve attachment 44 is engaged to provide valve attachment 44 in a closed position to prevent any material therein from exiting. Furthermore, a drain connector 46 is disposed on clear tubing first end 42A of clear tubing 42. Drain connector 46 may be a PVC connector of any suitable shape or angle. Additionally, valve attachment 44 is connected to a drain 72 disposed on a wall 73 outside of a building. Drain 72 is an existing drain output from an air conditioning unit disposed outside a building. The building may be an office building, a home, or any suitable area housing an air conditioning unit.

A method 100 for condensate drain line cleaning system 10 includes several steps. In a first step 110, a user mounts coil attachment assembly 20 to an evaporator coil section 71 of an existing air condoning unit. Connecting member 28 is received by coil section 71 thereon. Additionally, the user mounts drain attachment assembly 40 to drain 72 of an existing air conditioning unit disposed wall 73 of a building. Valve attachment 44 is then mounted to drain 72. A user then actuates valve lever 44A to configure valve attachment 44 in a sealed position to effectively seal drain 72. In a second step 120 a user then removes cap 29 disposed on T-connector 24 and pours a cleaning solution therein. A user continues to pour the cleaning solution until the cleaning solution is observed on clear portion 26 by the user. In a third step 130, a user then returns to coil attachment assembly 20 and begins to pour hot water therein to activate the cleaning solution that was previously poured. A user then waits a predetermined amount of time such as but not limited to thirty minutes, to allow the cleaning solution to thoroughly clean the drain line of the existing air condoning unit. In a fourth step 140, a user then returns to drain attachment assembly 40 and engages valve lever 44A such that valve attachment is now in an open position. This allows all the water and clogging material within the drain line to flow out of drain attachment assembly 40. Condensate drain line cleaning system 10 provides a user with a safe and efficient way of cleaning the drain line of an existing air conditioning unit. The drain line of an existing air conditioning system will then be thoroughly cleaned thereby saving money and time for a user.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A condensate drain line cleaning system, comprising:

a. a coil attachment assembly, including a tubing body with an elongated cylindrical shape having a body first end and a body second end, wherein said coil attachment assembly further includes a T-connector having a first T-end, a second T-end, and a third T-end, wherein said first T-end is mounted onto said body second end of said tubing body, wherein said coil attachment assembly further includes a clear portion, the clear portion is formed by a first clear portion and a second clear portion, both the first clear portion and the second clear portion are shorter in length than the tubing body's length, the second clear portion is mounted thereon said second T-end and is secured thereto by means of clamps, said first clear portion is attached to said body first end, wherein a connecting member is further mounted on said second clear portion opposite to said second T-end, said connecting member having a threaded portion at a distal end opposite to said second clear portion that is configured to be received by an evaporator coil section of an existing air conditioning unit, wherein a cap is removably attached on said third T-end of said T-connector, said cap is cylindrical with a closed top end, said cap is volumetrically suitable to fit into said third T-end thereby preventing leakages, a vend portion is connected to said first clear portion at an opposite end from where the body first end is attached, the vent portion is attached thereto by means of clamps, the vent portion is given as a T-shaped PVC attachment with a circular opening on a top end thereof, and b. a drain attachment assembly, including a clear tubing having a clear tubing first end and a clear tubing second end, said clear tubing having an elongated cylindrical shape formed by a flexible material, wherein a valve attachment having a valve lever is disposed on said clear tubing second end and secured thereto by means of clamps, wherein a drain connector is disposed on said clear tubing first end.

2. The condensate drain line cleaning system of claim 1 wherein said valve attachment is mounted to a drain disposed on a wall.

3. The condensate drain line cleaning system of claim 1 wherein said valve lever engages said valve attachment in a closed position to prevent any material from exiting said drain.

4. A condensate drain line cleaning system, consisting of:

a. a coil attachment assembly, including a tubing body made of PVC with an elongated cylindrical shape having a body first end and a body second end, wherein said coil attachment assembly further includes a T-connector having a first T-end, a second T-end, and a third T-end, wherein said first T-end is mounted onto said body second end of said tubing body, wherein said coil attachment assembly further includes a clear portion, the clear portion is formed by a first clear portion and a second clear portion, the second clear portion is mounted thereon said second T-end and is secured thereto by means of clamps, said first clear portion is attached to said body first end, wherein a connecting member is further mounted on said second clear portion opposite to said second T-end, said connecting member having a threaded portion at a distal end opposite to said second clear portion that is configured to be received by an evaporator coil section of an existing air conditioning unit, wherein a cap is removably attached on said third T-end of said T-connector, said cap is cylindrical with a closed top end, said cap is volumetrically suitable to fit into said third T-end thereby preventing leakages, a vend portion is connected to said first clear portion at an opposite end from where the body first end is attached, the vent portion is attached thereto by means of clamps, the vent portion is given as a T-shaped PVC attachment with a circular opening on a top end thereof, the vent portion is configured to provide means for gas relief, and b. a drain attachment assembly, including a clear tubing having a clear tubing first end and a clear tubing second end, said clear tubing having an elongated cylindrical shape formed by a flexible material, wherein a valve attachment having a valve lever is disposed on said clear tubing second end and secured thereto by means of clamps, wherein a drain connector is disposed on said clear tubing first end, said valve lever engages said valve attachment in a closed position to prevent any material from exiting said drain.

5. A method for a drain line cleaning system, comprising a. a first step, wherein a user mounts a coil attachment assembly to an evaporator coil section of an existing air conditioning unit and further mounts a drain attachment assembly to a drain disposed on a wall outside a building and then engages a valve attachment disposed on said drain attachment assembly;

b. a second step, wherein a user then removes a cap disposed on said coil attachment assembly and pours a cleaning solution therein;

c. a third step, wherein a user then pours hot water into said coil attachment assembly to activate said cleaning solution disposed therein and waits a predetermined amount of time; and fourth step, wherein a user then releases said valve attachment to dispose of water and waste material present within the drain line.

* * * * *